US005253697A

United States Patent [19]

LaJoye et al.

[11] Patent Number: 5,253,697

[45] Date of Patent: Oct. 19, 1993

[54] MANUFACTURE OF ARTICLES CONSISTING OF A COMPOSITE MATERIAL

[75] Inventors: Luc LaJoye, Montigny-les-Metz; Laurent LaJoye, Metz, both of France

[73] Assignee: Les Bronzes d'Industrie, societe anonyme, Amneville, France

[21] Appl. No.: 754,252

[22] Filed: Aug. 27, 1991

Related U.S. Application Data

[63] Continuation of Ser. No. 465,363, Jan. 16, 1990, abandoned.

[30] Foreign Application Priority Data

Jan. 16, 1989 [FR] France ..... 89 00447

[51] Int. Cl.[5] ..... B22D 13/02; B22D 19/02

[52] U.S. Cl. ..... 164/97; 164/286; 164/300; 264/311

[58] Field of Search ..... 164/286, 298, 299, 300, 164/94, 95, 97; 264/311

[56] References Cited

U.S. PATENT DOCUMENTS

| | | | |
|---|---|---|---|
| 2,152,717 | 4/1939 | Wehmeier et al. . | |
| 2,681,260 | 7/1951 | Kistler | 164/288 |
| 4,117,580 | 10/1978 | Heck | 164/102 |
| 4,211,269 | 7/1980 | Bentz | 164/94 |
| 4,631,793 | 12/1986 | Shintaku | 164/112 |

FOREIGN PATENT DOCUMENTS

| | | | |
|---|---|---|---|
| 0335012A1 | 10/1989 | European Pat. Off. . | |
| 2819120 | 11/1979 | Fed. Rep. of Germany . | |
| 3217091 | 5/1982 | Fed. Rep. of Germany . | |
| 50-29943 | 9/1975 | Japan | 264/311 |
| 57-70075 | 4/1982 | Japan . | |
| 57-77531 | 5/1982 | Japan | 264/311 |
| 58-6768 | 1/1983 | Japan | 164/97 |
| 58-6769 | 1/1983 | Japan . | |
| 59-127963 | 7/1984 | Japan | 164/97 |
| 1013080 | 11/1981 | U.S.S.R. . | |
| 1119771 | 10/1984 | U.S.S.R. . | |
| 1157054 | 7/1969 | United Kingdom . | |

*Primary Examiner*—Richard K. seidel
*Assistant Examiner*—Rex E. Pelto
*Attorney, Agent, or Firm*—Foley & Lardner

[57] ABSTRACT

An apparatus and process is disclosed for the preparation by molding of composite materials formed of a metallic or organic matrix and at least one reinforcing element which includes a mold having an axis of revolution, the mold being equipped with a rotator allowing it to rotate about its axis, with a device for feeding liquid matrix material and with a device for feeding a reinforcing element. The reinforcing element feeding device opens into the feed device of the matrix material-feeding device which causes turbulence. The feed device can be a shoot, a casting channel, a feed pipe, a funnel or another equivalent device.

8 Claims, 2 Drawing Sheets

MANUFACTURE OF ARTICLES CONSISTING OF A COMPOSITE MATERIAL

This application is a continuation of application Ser. No. 07/465,363, filed Jan. 16, 1990 now abandoned.

BACKGROUND OF THE INVENTION

1. Field of the Invention

The present invention relates to an apparatus for the preparation of composite metallic or organic materials by centrifuging, a molding process using the apparatus, the composite materials obtained and the articles formed from these materials.

2. Discussion of the Related Art

The manufacture of metallic articles of revolution by centrifuging is well known. The process typically involves introducing the metallic material in the molten state into a rotating mold.

This process has also been used for a mixture consisting of a metal alloy in the liquid state and a reinforcing agent, such as graphite, a ceramic, etc. By use of this process, articles formed from a reinforced metal alloy have been obtained.

However, this process has at least two disadvantages. On the one hand, the distribution of the reinforcing agent in the manufactured article is not precisely controlled. Distribution depends essentially on the difference in density between the matrix material and the reinforcing agent. Thus, depending on the amount of this difference, the distribution of the reinforcing agent will be more or less uniform.

On the other hand, some products capable of being good reinforcing agents cannot form a stable mixture with the liquid metallic matrix material for a sufficiently long period of time; thus, the reinforcing agent separates from the metallic matrix material before it has been possible to cast the latter into the mold. This is true, for example, of copper/graphite-powder alloy mixtures. The wettability of the graphite in liquid copper alloys is very low, even when the graphite particles are coated with nickel or copper. If the graphite powder is mixed with a liquid copper alloy, the powder separates after a very short time—less than 2 seconds. It is therefore impossible, by casting such a mixture into a rotating mold, to control the distribution of the reinforcing agent in the metallic article.

SUMMARY OF THE INVENTION

Accordingly, it is an object of the present invention to develop an apparatus for the preparation of composite materials by centrifuging, which does not have the disadvantages mentioned above.

The foregoing and additional objects are attained according to the present invention by providing an apparatus for the preparation of composite metallic or organic materials by molding. Furthermore, a process is provided for the manufacture of composite materials by molding, which is carried out by means of the apparatus. Composite materials obtained thereby and the articles produced from composite material are also provided according to the present invention.

The apparatus for the preparation by molding of composite materials formed of a metallic or organic matrix and at least one reinforcing element comprises a mold having an axis of revolution, the mold being equipped with means allowing it to rotate about its axis, with a device for feeding liquid matrix material and with a device for feeding a reinforcing element. The reinforcing element feeding device opens into the flow-off zone of the matrix material-feeding device. The feed device can be a shoot, a casting channel, a feed pipe, a funnel or another equivalent means.

In the apparatus according to the invention, the rotational axis of the mold can be oblique. The feed device is not necessarily parallel to the rotational axis of the mold or coaxial therewith. However, it is essential that the device for feeding the reinforcing element should open into a zone located near the end of the flow-off zone of the device for feeding matrix material, thereby providing a mixing zone in the immediate vicinity of the entrance of the mold.

The rotational axis of the mold can be horizontal or nearly horizontal. The reinforcing element-feeding device then preferably opens vertically into the flow-off zone of the matrix material feeding device.

In another preferred embodiment, the rotational axis of the mold is vertical or nearly vertical. The reinforcing element-feeding device then preferably has a tubular flow-off zone, the end of which opens into the flow-off zone of the matrix material-feeding device, the flow-off streams in the flow-off zones of the two feed devices being substantially parallel. In this case, the end of the flow-off zone can be curved towards the vertical wall of the mold.

The process according to the present invention for the preparation of composite materials formed from a metallic or organic matrix and reinforcing elements involves feeding the matrix material in the liquid state and at least one reinforcing agent into a rotating mold by means of the apparatus according to the invention. When such a process is being carried out, the metallic or organic matrix material and the reinforcing agent or reinforcing agents are conveyed to the entrance of the mold separately, but the incorporation of the reinforcing element into the matrix material takes place immediately before this matrix material is fed into the mold.

By adopting this process, it is possible to incorporate into a matrix material reinforcing agents taking the form of particles or short fibers, having a very low wettability in the matrix material. The zone in which mixing takes place is very limited, but the turbulences generated in this zone by the arrival of a stream of reinforcing elements in the flow-off stream of the matrix material make it possible to produce an excellent mixture between the matrix material and the reinforcing elements. Moreover, this zone is located just before the point where the material is cast into the mold. Consequently, the time elapsing between the moment when the reinforcing elements are mixed with the matrix material and the hardening of the material in the mold is sufficiently short to ensure that the reinforcing elements cannot separate from the matrix material.

By adjusting the various casting parameters, either articles of material having reinforced zones of revolution or articles of material reinforced uniformly can be obtained. The latter cannot be obtained by means of conventional centrifugal molding appliances when the reinforcing element does not have sufficient wettability or its density is substantially different from that of the matrix.

For example, the casting time of the matrix material and the casting time of the reinforcing element can be selected.

In an alternative version of the process of the present invention, the addition of the reinforcing agent can be delayed in relation to the start of casting of the matrix material when only the interior of the article is to be reinforced. It is thus possible to avoid trapping some of the reinforcing elements on the outside of the articles. In prior methods, this trapping tends to occur as a result of the virtually instantaneous solidification of the outer skin zone.

By sufficiently delaying the casting of the reinforcing element in relation to the start of casting of the matrix material, a reinforced zone of revolution nearer the bore will be obtained.

Furthermore, it is preferable that the casting of the reinforcing element terminates before or, at most, at the same time as the casting of the matrix material, to prevent the presence of free reinforcing elements in the bore of the article of composite material obtained.

The choice of temperatures makes it possible to influence the amount of reinforcing element in the zones to be reinforced. Thus, a lower temperature of the mold, that is to say a higher cooling rate, gives more rapid solidification in the vicinity of the wall of the mold, thus reducing the risks of separation between the reinforcing elements and the matrix material as regards reinforcing elements having low wettability in the matrix material. Furthermore, the temperature of the matrix material affects both the solidification rate and the ease with which the reinforcing elements are incorporated into this matrix. The temperature of the reinforcing elements can also play a part in the ease with which these reinforcing elements are incorporated in the matrix.

Another factor influencing the distribution of the reinforcing element is the difference between the density of the matrix material and that of the reinforcing element. The higher the density of the reinforcing element in relation to that of the matrix material, the more this reinforcing element will tend to be located on the periphery of the article. In the opposite case, the reinforcing element is in a higher concentration around the bore.

Moreover, a higher rotational speed of the mold intensifies the effect attributable to the other factors.

The type and thickness of lubricant plays an important part in the solidification rate of the article. Thus, a thick insulating lubrication will give rise to a slow solidification of the article, thus assisting the reinforcement of its periphery (this is used with reinforcing elements of a density higher than that of the matrix).

One of the essential advantages of the apparatus of the invention is that it makes it possible selectively to reinforce locally one or more characteristics of an article of matrix material having an axial rotational symmetry. For this purpose, it is sufficient to choose the reinforcing element or reinforcing elements suitable for the desired characteristic and the conditions for carrying out the process which are capable of making it possible to reinforce the desired zone.

The apparatus according to the invention also makes it possible to reinforce two zones of the same article by means of different reinforcing elements. In this case, the operating mode depends on the difference between the densities of each of the reinforcing elements. If their densities are very close to one another, the reinforcing element for the outer zone of the article is injected first. If the reinforcing element of the outer zone has a density markedly higher than that of the inner zone, the two reinforcing elements can be mixed before being incorporated into the matrix material in the liquid state. During casting by centrifuging, the settling of the reinforcing elements will bring about the desired distribution within the article. In this case, it is beneficial to select the temperatures so that solidification is sufficiently slow to allow the heaviest elements to come into place on the outside.

The apparatus according to the invention can be used for virtually all metal alloys, alloys with a copper base (for example, bronze, cupro-aluminum, brass) and aluminum alloys.

It can also be used for organic materials, such as, for example, articles of PVC, epoxy resin, polyester or methacrylate, reinforced with particles of silicon carbide to give the periphery properties of high wearing resistance.

The reinforcing elements can take the form of particles or short fibers. For example, particles of graphite, silicon carbide or chromium carbide can be used. To improve the wettability of the particles or short fibers of graphite when they are intended for reinforcing copper alloys and aluminum alloys, it is advantageous to coat them, for example, with a layer of nickel or copper, the thickness of which can vary between 1 and 50 $\mu$m.

Further objects and advantages should become apparent to those skilled in the art by reference to the specification and drawings which follow.

DETAILED DESCRIPTION OF THE PREFERRED EMBODIMENTS

Figure 1:
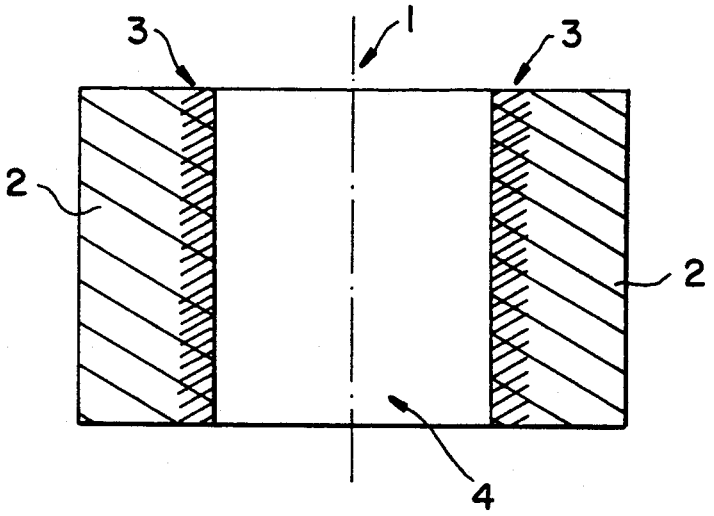
FIGS. 1, 2 and 3 each show an axial section of different articles of revolution made of a composite material.
Figure 2:
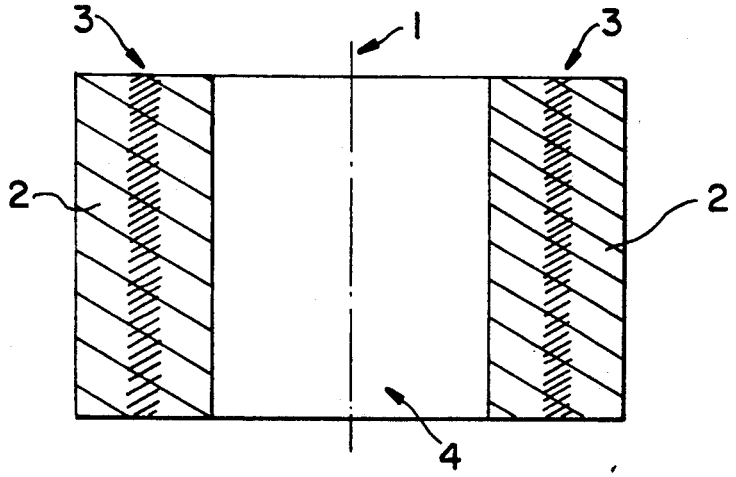
Figure 3:
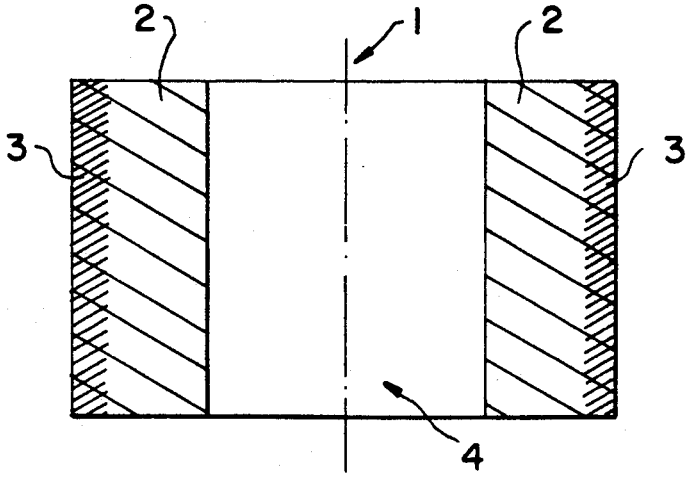

In FIGS. 1–3, 1 designates the axis of revolution of the article, 2 denotes the article, 3 designates the reinforced part and 4 denotes the bore of the article 2.

Figure 4:
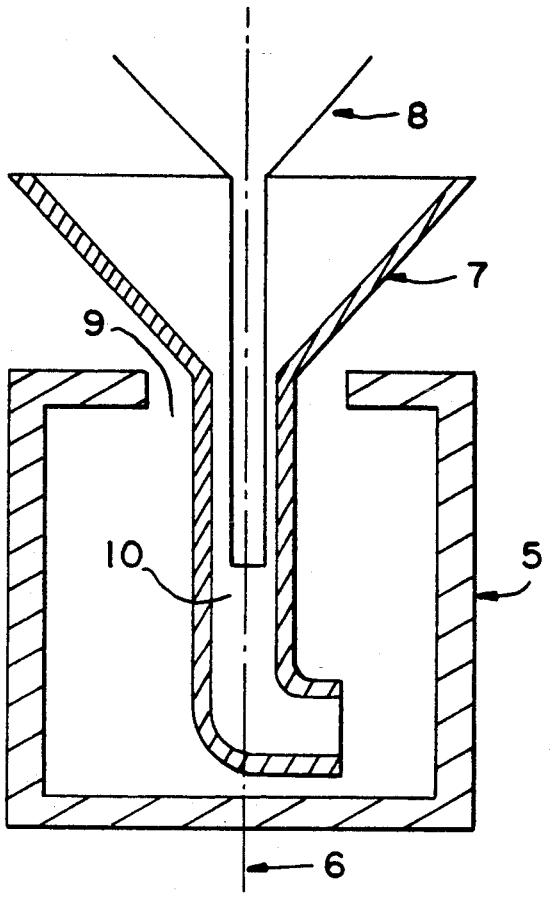
FIGS. 4 and 5 each show a schematic diagram of an apparatus according to the invention.

FIG. 4 illustrates a mold 5 rotating about a vertical axis 6. The matrix material is introduced into the mold by a first shoot 7 which enters the mold through an opening 9. The reinforcing elements are introduced by a second shoot 8. This second shoot 8 opens into a zone 10 of the end part of the first shoot 7, so that the mixing of the matrix material and the reinforcing elements can take place immediately before introduction into the mold.

When the mixture in a liquid state is introduced into the mold 5, which is driven rotationally about the axis 6, it falls onto the bottom of the mold and the centrifugal forces attributable to the rotation of the mold distribute it over the vertical walls of the mold. To make it easier to place the material onto the walls of the mold, it can be preferable to use a shoot 7, the end part of which is located on the inside of the mold, rather than at the entrance of the mold, and which is curved so that the stream of material is directed towards the wall of the mold.

When the reinforcing elements are incorporated into the matrix material in the zone 10, the turbulences generated in this zone 10 are sufficient to produce excellent mixing between the matrix material and the reinforcing elements.

Figure 5:
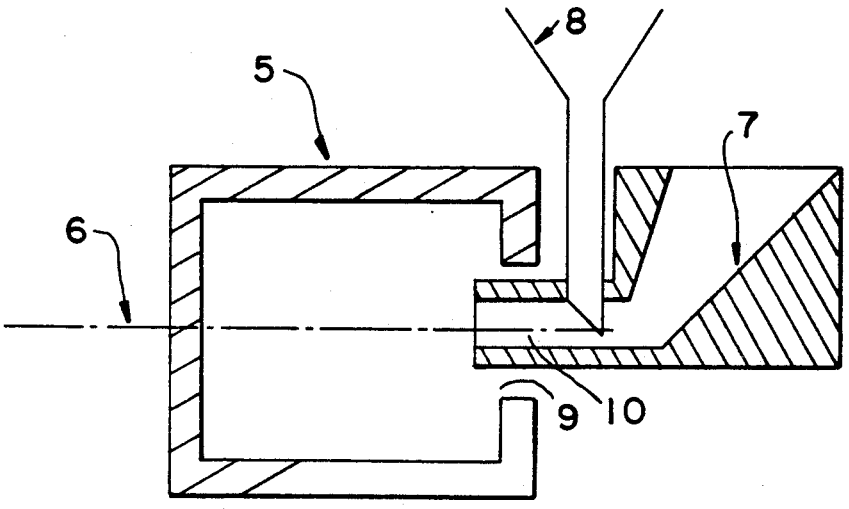

FIG. 5 illustrates an alternative embodiment of the apparatus according to the invention. In this embodiment, the elements equivalent to those of FIG. 4 are designated by the same reference numerals. In this alternative version, the mold 5 rotates about a horizontal axis 6. During the introduction of the matrix material (or of the mixture of the matrix material and reinforcing element), the latter falls onto the wall of the mold 5, and is distributed as a result of the centrifugal forces.

The process of the invention is advantageously used for the manufacture of metallic or organic articles having an axial rotational symmetry with zones of revolution in which some properties are reinforced. These articles of axial rotational symmetry can be articles which can be used as such (bearings, rings, etc.). These articles can also form a material from which articles that are not "rotationally symmetrical" will be cut. The production of rods or rails having a reinforced zone is thus possible.

An especially beneficial use is the production of locally self-lubricating bearings. The metallic matrix of such bearings is generally a copper alloy or an aluminum alloy. The reinforcing element used is graphite in the form of particles of a mean size of 5 to 500 μm, if appropriate covered with a layer of nickel or copper having a thickness of the order of 1 to 10 μm. A self-lubricating bearing can be produced by means of an apparatus, such as that illustrated in FIGS. 4 or 5. The volume of graphite powder is a function of the thickness and the graphite concentration of the desired self-lubricating zone in the bearing.

The casting of the graphite powder takes place via the second shoot 8, and the casting of the matrix material via the first shoot 7. To avoid trapping graphite particles on the outside of the articles as a result of the virtually instantaneous solidification of the outer skin zone, the powder may arrive in the powder/alloy mixing zone 10 a moment after the start of casting of the matrix material. It is desirable that the casting of the powder should terminate before or, at the latest, at the same time as the casting of the matrix material, to prevent the presence of free powder in the bore. Because of the difference in density between the matrix material and the powder, the latter settles immediately inside the article, this settling being greatly intensified by the centrifuged acceleration within the centrifuged article ($\gamma=20$ to 200 g). To prevent the powder from being thrown out of the article via the bore—especially where a matrix on a copper base is used—the mold must be sprayed intensively, in order to cause the solidification front to advance very quickly towards the inside of the article, thereby allowing it to catch the particles and retain them in the solidified matrix material.

As shown in FIG. 1, the articles thus produced have a high proportion of graphite in the bore, thereby making them self-lubricating.

Tests were conducted under the same conditions as above, but with apparatuses of the prior art, in order to manufacture rotationally symmetrical articles comprising a copper or copper alloy matrix reinforced by graphite particles. The matrix material and the reinforcing element were mixed and then introduced into the rotating mold through a single shoot. This produced a molded article having free particles of graphite powder on its surface. The mixture of the matrix material and reinforcing element therefore separated during its casting into the mold.

Where articles with a bronze matrix (for example, of the type UE 12) are concerned, the presence of porosities within the graphitized zone performs the function of a pocket for lubrication and for dust arising from the running-in period. In fact, during this period, particles of graphite and bronze can be torn from the article and then come to rest in these porosities, thereby avoiding any wear of the mating article by abrasion. However, the presence of porosities can be reduced by adding a powder of aluminum, phosphorus, copper phosphide, zinc or calcium to the covered graphite powder. The very small percentage will be a function of the number of porosities which the type of use of the bearing will allow. This powder will be added to the coated graphite powder very carefully in order to prevent any heterogeneity of the composition.

The process according to the invention makes it possible to obtain rotationally symmetrical articles of which the length can vary from about 2 to about 7000 mm and the outside diameter from about 30 to about 7000 mm.

The process according to the invention can also be used for the shaping of articles with a reinforced organic matrix. It is thus possible to produce articles of which the periphery can be reinforced, for example by particles of silicon carbide (SiC), in order to make it especially resistant to abrasion, or by graphite particles, in order to make the exterior self-lubricating.

It should be obvious to those skilled in the art that the present invention is not limited to the preferred embodiments shown and described.

What is claimed is:

1. An apparatus for molding composite materials from a metallic or organic matrix and at least one reinforcing element, comprising:
   - a mold having an axis of rotation;
   - means for rotating said mold about said axis of rotation;
   - first means for feeding a liquid matrix material into said mold, said first feeding means having a tube with an exit end opening into the mold; and
   - second means for feeding reinforcing elements into said mold, said second feeding means opening within the tube of said first feeding means, whereby the reinforcing elements generate turbulence in the liquid matrix material such that the reinforcing elements and the liquid materials are mixed immediately prior to exiting the exit end of the tube.

2. The apparatus according to claim 1, wherein the exit end of said first feeding means is located within said mold and is directed toward a wall of said mold.

3. The apparatus according to claim 2, wherein said first and second feeding means are selected from the group consisting of feed pipes, casting channels, and shoots.

4. The apparatus according to claim 1, wherein the axis of rotation of said mold is substantially vertical and the feed directions of said first and second feeding means are substantially co-axial therewith.

5. A process for molding composite materials from a metallic or organic matrix and at least one reinforcing element, comprising:
   - rotating a mold about an axis of rotation;
   - feeding a liquid matrix material into the mold via a tube;
   - feeding reinforcing elements into the mold;
   - introducing the reinforcing elements within a stream of the liquid matrix material, within the tube, thereby generating turbulence within the tube;
   - mixing the liquid matrix material and the reinforcing elements via the generated turbulence within the tube; and
   - placing the mixed liquid matrix material and reinforcing elements into the mold;

wherein the mixing and introducing steps are performed immediately prior to placing the mixed liquid matrix material and reinforcing elements into the mold.

6. The process according to claim 5, wherein the step of feeding the liquid matrix material and the step of feeding the reinforcement elements are performed substantially simultaneously.

7. The process according to claim 5, wherein the step of feeding the liquid matrix material is performed immediately prior to the step of feeding the reinforcing elements.

8. An apparatus for molding composite materials from a metallic or organic matrix and at least one reinforcing element, comprising:

a mold having a substantially horizontal axis of rotation;

means for rotating said mold about said axis of rotation;

first means for feeding a liquid matrix material into said mold, said first feeding means being substantially horizontal and having a tube with an exit end opening into the mold; and second means for feeding reinforcing elements into said mold, said second feeding means opening within the tube of said first feeding means, whereby the reinforcing elements generate turbulence in the liquid matrix material such that the reinforcing elements and the liquid material are mixed immediately prior to exiting the exit end of the tube;

wherein the feed direction of said second feeding means is substantially perpendicular to the feed direction of said first feeding means.

* * * * *